US006354587B1

(12) United States Patent
Engarto

(10) Patent No.: US 6,354,587 B1
(45) Date of Patent: Mar. 12, 2002

(54) FOLLOWER MECHANISM FOR FLAT ARTICLE HANDLING SYSTEM

(76) Inventor: Edward S. Engarto, 276 Talmidge Hill Rd. West, Waverly, NY (US) 14892

( * ) Notice: Subject to any disclaimer, the term of this patent is extended or adjusted under 35 U.S.C. 154(b) by 0 days.

(21) Appl. No.: 09/578,122

(22) Filed: May 24, 2000

(51) Int. Cl.[7] ..... B65H 1/02

(52) U.S. Cl. ..... 271/149; 271/31.1; 271/129; 271/157; 271/150; 221/227

(58) Field of Search ..... 414/798.6, 798.7, 414/798.9; 271/31.1, 129, 149, 157; 221/279, 227; 211/79, 80

(56) References Cited

U.S. PATENT DOCUMENTS 4,757,985 A * 7/1988 Hamant et al. ..... 271/149
5,116,039 A * 5/1992 Braen et al. ..... 271/149
5,829,742 A * 11/1998 Rabindran et al. ..... 271/150
5,890,712 A * 4/1999 Phillips et al. ..... 271/157

* cited by examiner

*Primary Examiner*—H. Grant Skaggs
(74) *Attorney, Agent, or Firm*—Wolf, Greenfield & Sacks, P.C.

(57) ABSTRACT

A follower mechanism is provided for use in a system for feeding flat articles, such as mixed mail, which follower mechanism includes a paddle assembly connected to a mount so as to be pivotable between a feed position and an inactive position, and mechanism for permitting the paddle mount to be freely moved in either direction when the paddle assembly is in its inactive position, but to be drivable only in the forward direction when the paddle is in its feed position. A counterbalance mechanism is provided to control downward movement to the paddle and to assist in the lifting of the paddle. A mechanism may also be provided for positively disengaging the mount for the paddle from the drive mechanism.

21 Claims, 5 Drawing Sheets

FOLLOWER MECHANISM FOR FLAT ARTICLE HANDLING SYSTEM

FIELD OF THE INVENTION

This invention relates to systems for handling mixed mail and related flat articles, and more particularly to a follower mechanism adapted for feeding such articles to a singulation head or other processing mechanism.

BACKGROUND OF THE INVENTION

When articles, such as mixed mail, are received at a processing location, they must be initially organized in a manner so that they may be sorted or otherwise processed. In many cases, this involves manually stacking the mail or other articles on a feeder machine which delivers the articles to a singulation head or other suitable processing apparatus. Frequently, the feeding machine is the sole interface with a human operator in the entire mail/article processing system, at least until processing of the articles has been completed and they are ready to be removed. Therefore, it is particularly important that this portion of the machine be both safe and accommodating to the ergonomic needs of the operators.

Feeder machines for mixed mail typically include some type of follower mechanism, the operator forming a stack of mail between the follower mechanism and, for example, a singulation head of a mail processing machine. The follower then operates, generally in conjunction with a drive belt, to deliver the mail stack to the singulation head, while maintaining a desired orientation for the stack and a desired pressure for the lead piece of mail on the stack against the singulation head. An example of a system of the type indicated above is shown in co-pending application Ser. No. 09/411,961, filed Oct. 4, 1999; a mechanism for controlling orientation of the stack and pressure of the stack against a singulation head in such a system is disclosed in co-pending application Ser. No. 09/499,184, filed Sep. 23, 1999. The subject matter of these two prior-filed application is incorporated herein by reference.

In any such system where mail or other flat articles are being manually stacked in front of a follower, which follower is drivable to feed the articles, either alone or in combination with other drive mechanisms, the follower, along with its retracting, driving and linear guidance components, should be designed so as to be as easy, comfortable and safe for the operator to use as possible. Ease and comfort of use in particular can facilitate more rapid loading of the system by the operator, the time required for the operator to load the mail onto the feeding machine being one of the limitations on through-put for such machines. Durability and maintainability are other important criteria.

Unfortunately, many existing feeder machines are dangerous for operators, are unreliable and are maintenance intensive. They can also be awkward to load, particularly where is necessary to either load a fixed amount of mail (too few or too many mail items causing reliability problems), or to use one hand to serve as a temporary follower during the loading operation. A need therefore exists for an improved follower mechanism with enhanced ease, comfort and safety for the operator, as well as enhanced reliability and durability.

SUMMARY OF THE INVENTION

In accordance with the above, this invention provides a follower mechanism for use in an system for feeding flat articles, such as mixed mail, in a selected direction. The follower mechanism includes a paddle assembly; a mount to which the paddle assembly is pivotably connected, the paddle assembly being pivotable on its mount between a feed position and an inactive position; a guide connected to the mount, the guide facilitating movement of the mount only forward and backward in the selected direction; a drive providing controlled movement in the selected direction; and a mechanism connecting the mount to be driven forward in the selected direction by the drive, while inhibiting backward movement of the mount when the paddle assembly is in its feed position, the mechanism permitting the mount to be freely moved forward and backward when the paddle assembly is in its inactive position. The follower mechanism preferably includes a counterbalance mechanism which controls pivot movement of the paddle assembly between its two positions, the counterbalance mechanism applying a force to the paddle assembly which assists in raising the paddle assembly from its feed to its inactive position and partially supports the weight of the paddle assembly when the paddle assembly is lowered from its inactive to its feed position. For preferred embodiments, the counterbalance mechanism includes a compression spring mechanism positioned in the mount. The counterbalance mechanism preferably exerts greatest force on the paddle assembly when the paddle assembly is in its feed position.

For preferred embodiments, the mechanism connecting the mount to the driver includes a slide member normally biased to a raised position, by for example the counterbalance mechanism, the slide member interacting with the paddle assembly, starting at a point in the movement of the paddle assembly between its inactive and feed positions, to move the slide downward towards the drive; the slide member includes a component at the bottom thereof which engages the drive when the paddle assembly has reached its feed position. For preferred embodiments, the drive is a chain drive, and the component at the bottom of the slide member which engages the drive is a pawl. The pawl is preferably shaped to prevent disengagement of the pawl from the chain as a result of back pressure applied to the paddle assembly. A mechanism is preferably provided which is operative in response to the paddle assembly being moved from its feed to its inactive position for positively disengaging the pawl from the chain. For a preferred embodiment, this disengagement mechanism includes a hook on the slide and a pin on the paddle assembly, the pin being engaged by the hook during portions of pivot movement of the paddle assembly which are in a direction substantially perpendicular to the chain. Where positive disengagement of the pawl from the chain is provided, a hold-down member is preferably provided for the chain, the hold-member facilitating disengagement of the pawl from the chain. For preferred embodiments, the hold-down member is attached to the mount for the paddle assembly. The mechanism for connecting the mount to the drive preferably causes the pawl to be moved substantially perpendicular to the chain during engagement and disengagement of the pawl and chain. For preferred embodiments, the guide is a bearing. For some embodiments, the counterbalance mechanism may be utilized independent of the particular mechanism for connecting the slide member to the drive, although these two features are preferably utilized together.

The foregoing and other objects, features and advantages of the invention will be apparent from a following more particular description of an illustrative embodiment as shown in the accompanied drawings, the same reference numerals being used for common elements in the various figures.

IN THE DRAWINGS

DETAILED DESCRIPTION

Figure 1:
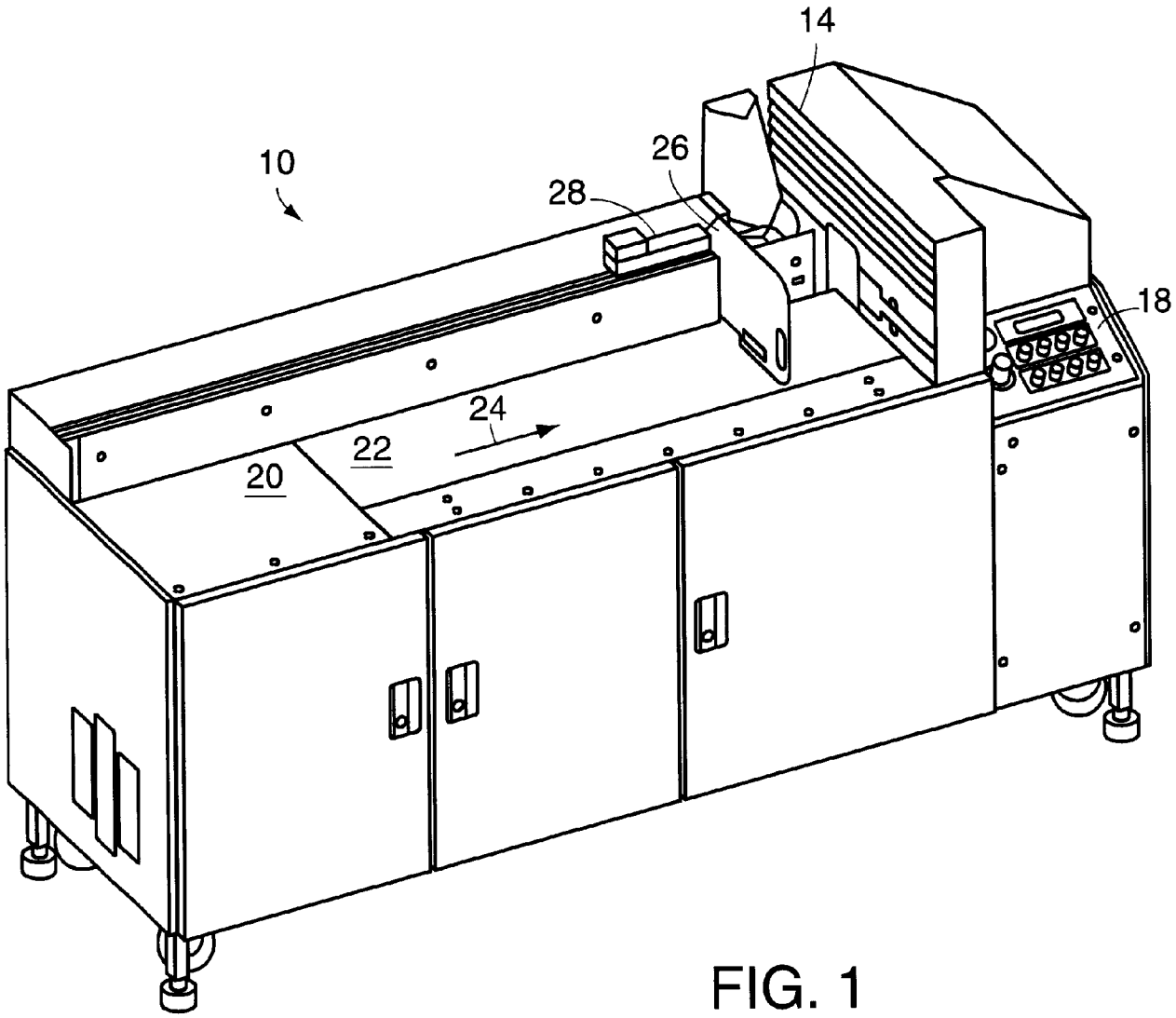
FIG. 1 is a perspective view of a mixed mail feeder system of a type in which the teachings of this invention may be practiced.

FIG. 1 illustrates a mixed mail feeding system 10 which consists of a mail feed machine 12, a singulation head 14, a take-away mechanism 16 and a control computer 18. While control computer 18 for the illustrative embodiment is shown located at system 10 and as having a keyboard and a monitor, the control computer need not be located at system 10 and need not have a separate keyboard and monitor (for example several systems 10 can be controlled by a single separately located computer, or a slave control could be located at the system without input or output devices, the slave interfacing with a master computer). Feeder machine 12, for the illustrative embodiment, includes a stacking table 20 having a rotating belt 22 mounted thereon, belt 22 being driven in direction 24 by a suitable driving mechanism (not shown). The drive mechanism for belt 22 could for example include a roller at each end of the belt, at least one of which rollers is driven by a servo motor under control of computer 18. A paddle 26 extends upward substantially perpendicular to belt 22 and is attached to a corresponding arm 28, the paddle and arm for this embodiment forming a paddle assembly which is mounted so that the paddle assembly may be pivoted away from belt 22 in a manner to be described shortly. A separate drive mechanism to also be described in detail later, is provided for the paddle assembly under control of computer 18. The movements of belt 22 and paddle 26 are independent, but are coordinated by processor 18. While it is within the contemplation of the invention that for example table 20 be of a low friction material so that belt 22 is not required, for reasons discussed in the co-pending applications, and in particular to maintain a desired pressure and orientation for the mail against singulation head 14, the use of both belt 22 and paddle 26 is preferred. As is discusses in greater detail in the co-pending applications, the pieces of mail in a stack delivered to singulation head 14 by feeder machine 12 are singulated by head 14 and taken away by take-away mechanism 16 to be delivered to sorter or other suitable downstream equipment.

FIGS. 2A and 2B-4 are various views of follower mechanisms incorporating a paddle 26 in accordance with illustrative embodiments of the invention. Referring to these figures, paddle 26 is fixedly connected to the corresponding arm 28. Arm 28 is connected to a mount 40 by a bolt 42 which passes through a hole in the mount, the mounting of arm 28 to mount 40 being, such that the arm, and paddle 26 connected thereto, can be manually rotated about bolt 42 to move paddle 26, and the paddle assembly of which it is a part, between an operative feed position shown in FIGS. 1 and 3 and an inactive position shown in FIGS. 2A, 2B.

Figure 2A:
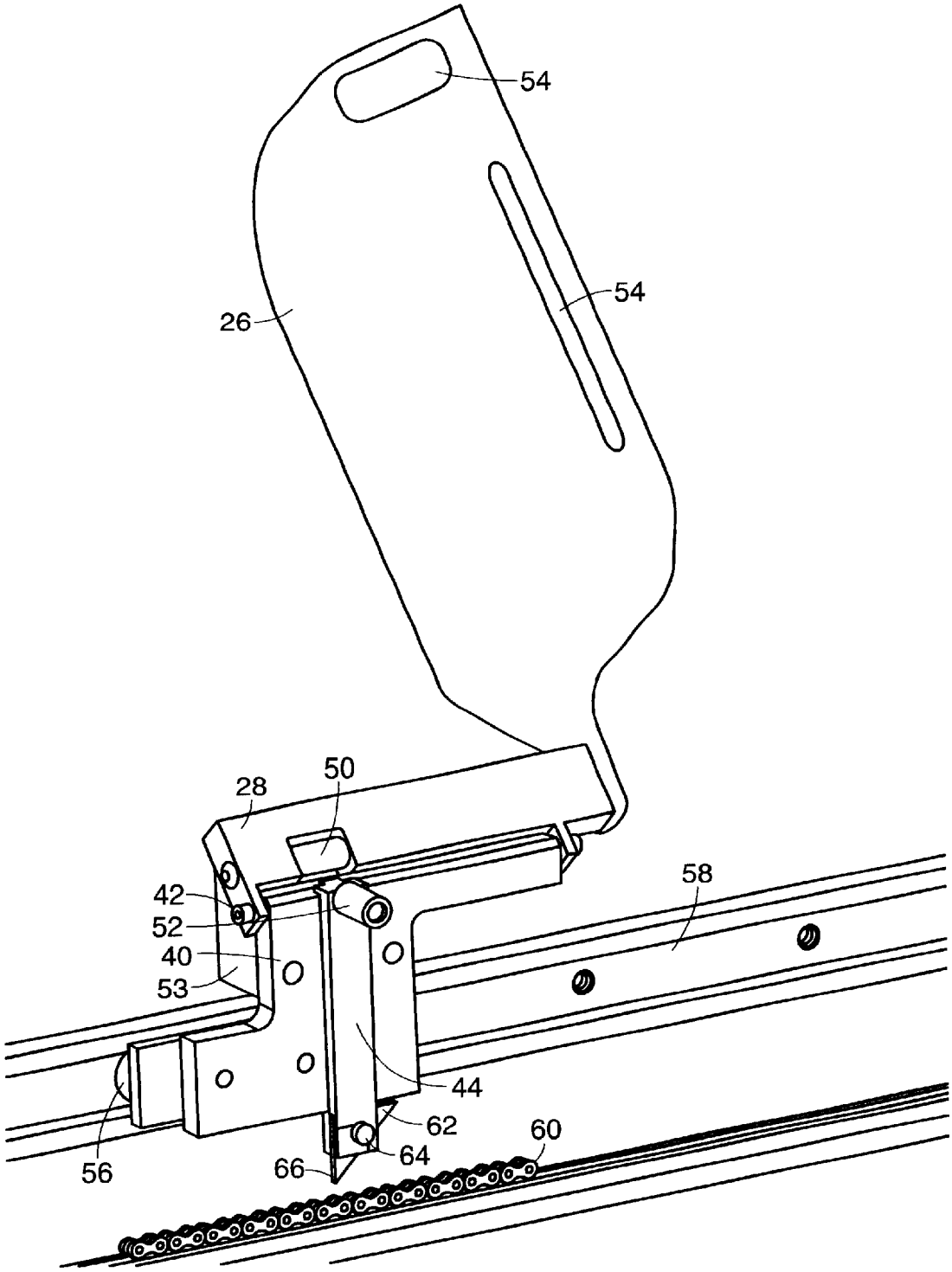
FIG. 2A is an enlarged perspective view of a first embodiment of a follower mechanism incorporating the teachings of this invention, shown with the paddle in its inactive position.
Figure 2B:
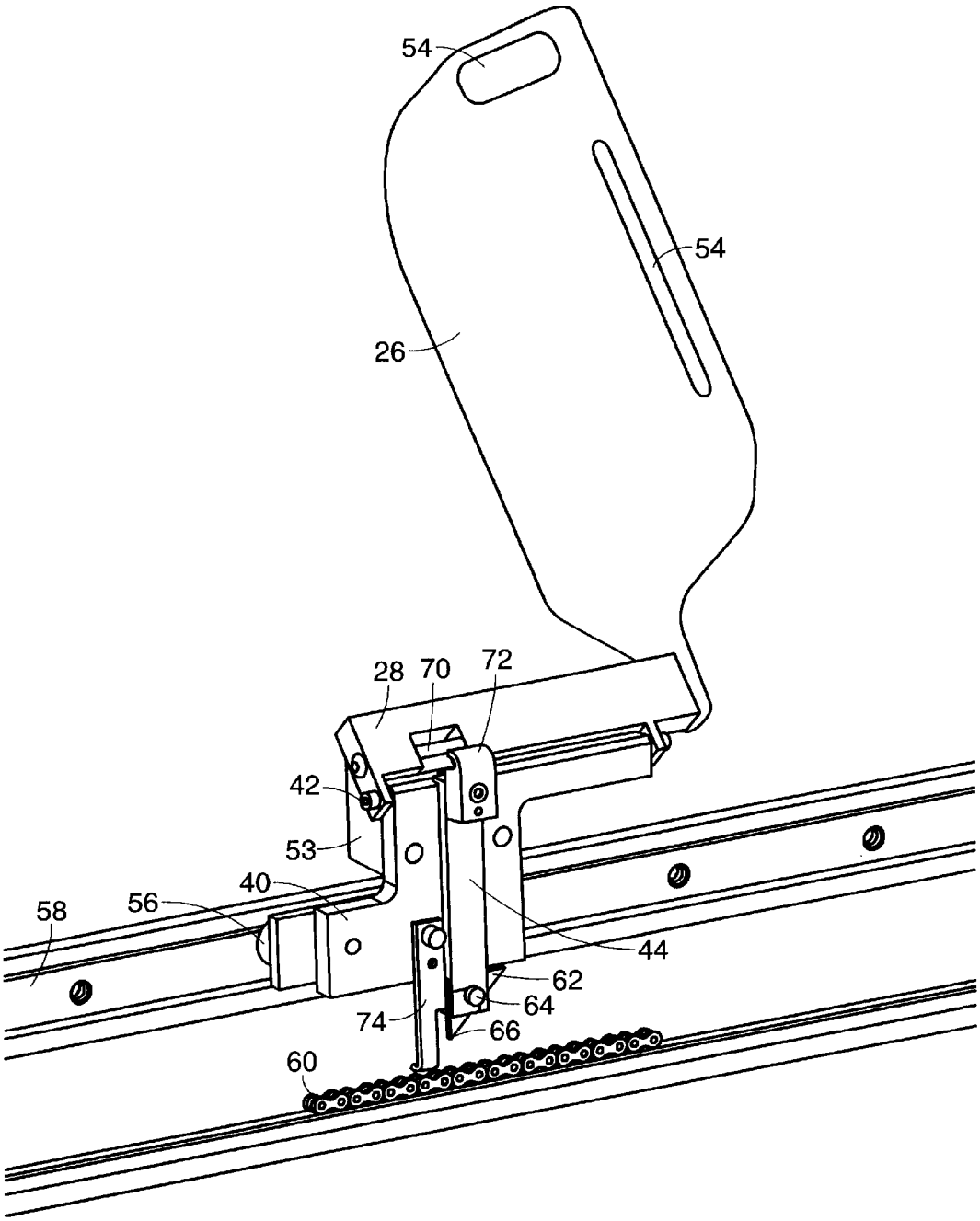
FIG. 2B is the same perspective view as FIG. 2A for a second embodiment.
Figure 3:
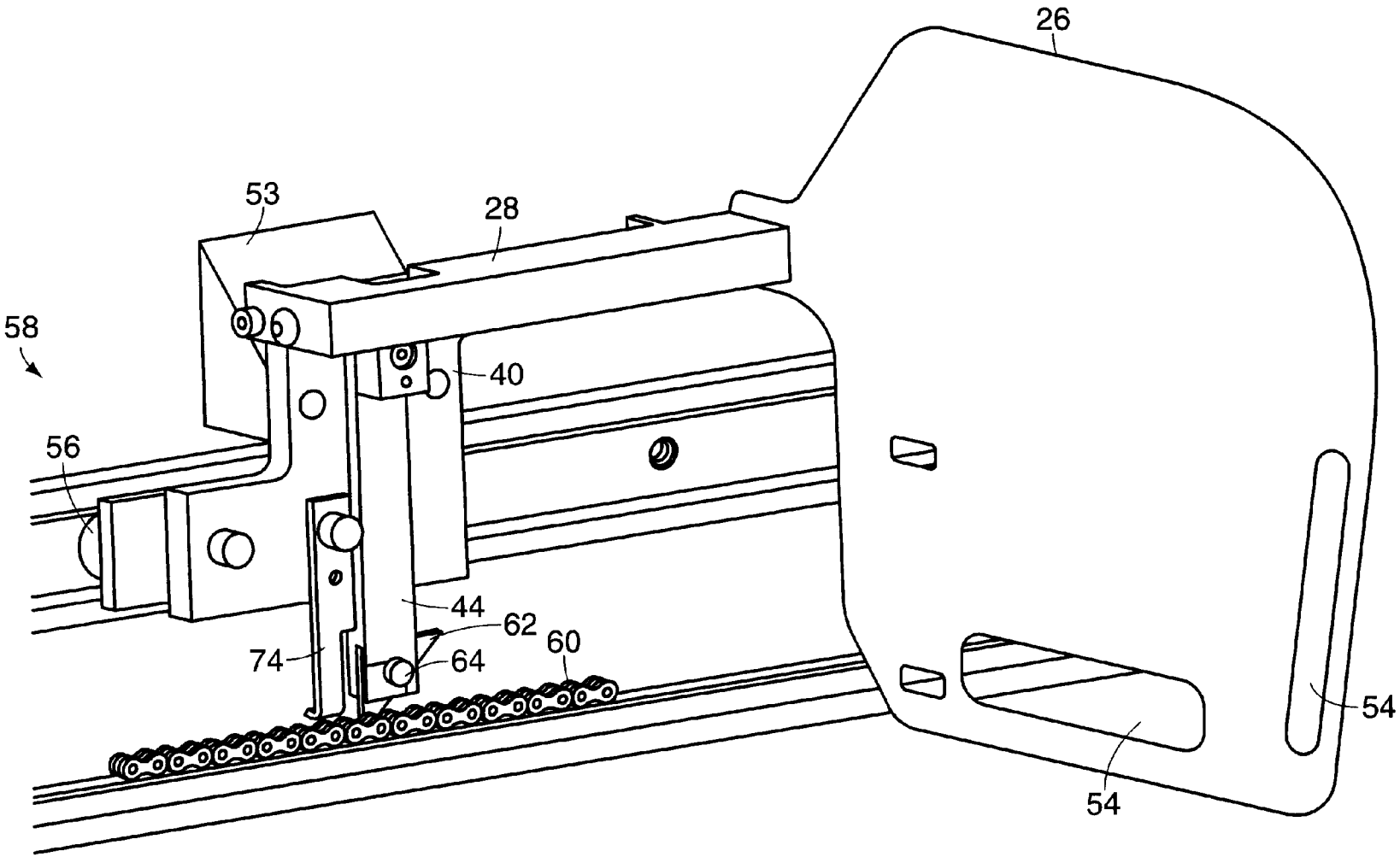
FIG. 3 is a perspective view of the follower mechanism of FIG. 2B with the paddle in its active or feed position.
Figure 4:
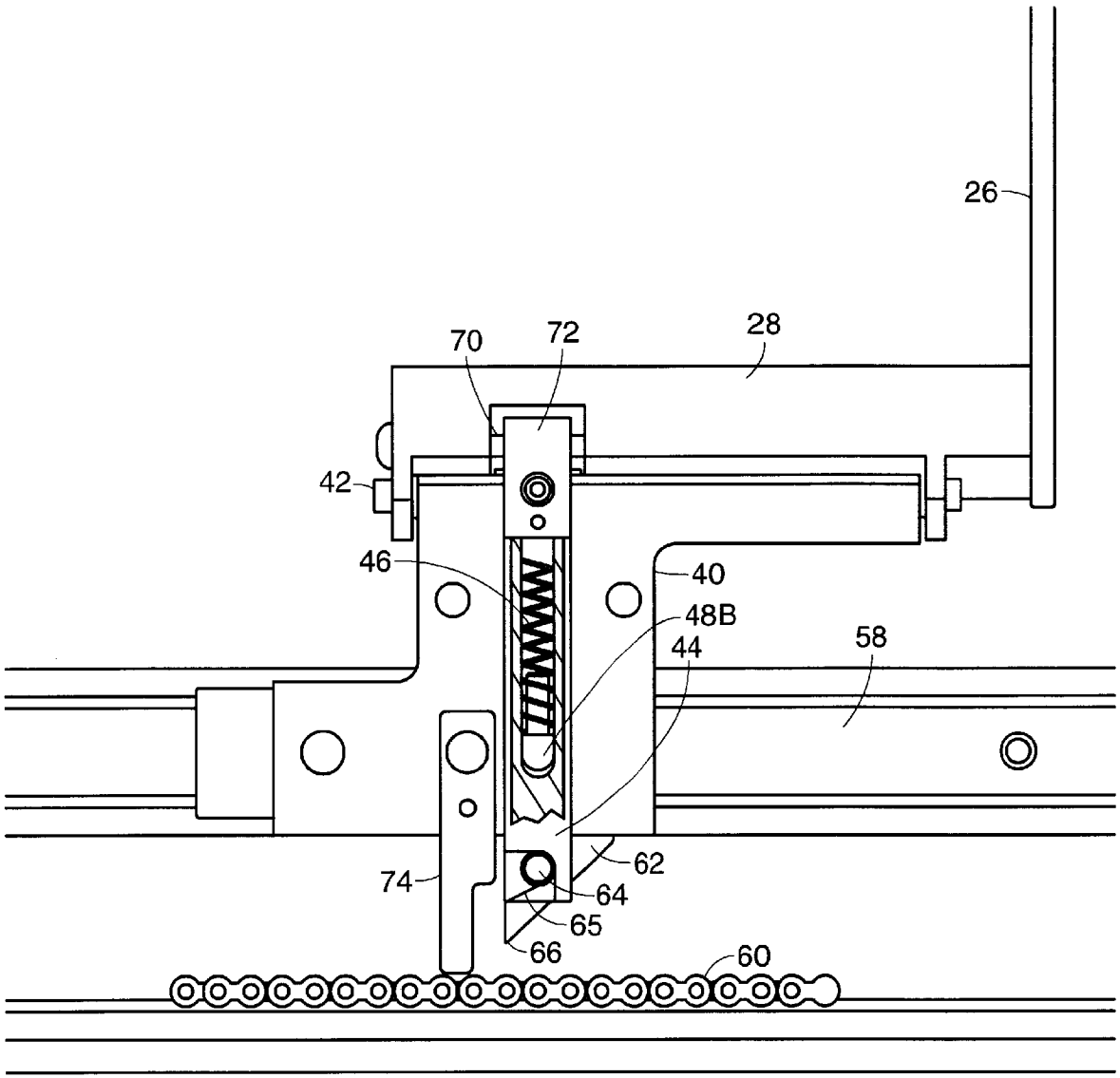
FIG. 4 is a front, partially cut-way view of a portion of the follower mechanism of FIGS. 2B and 3, FIG. 4 showing in particular the counterbalancing mechanism.

Mount 40 has a slide member 44 mounted therein which is biased by a counterbalance spring 46 (FIG. 4) to normally be in the raised position shown in FIGS. 2A, 2B and 4. Spring 46 is mounted in a recess formed in mount 40 between a pair of endcaps 48T and 48B. Upper endcap 48T extends so as to be in contact with slide 44 and to move therewith. For the first embodiment of the invention shown in FIG. 2A, a button 50 is provided on arm 28 which co-acts with a button 52 on slide member 44 to drive slide member 44 down when paddle 26 is lowered from its inactive position to its feed position. From FIG. 2A, it can be seen that buttons 50 and 52 do not initially make contact and paddle 26 must be rotated to some angle, for example 45°, before such contact is established. Therefore, during the initial movement of paddle 26, when gravity is not assisting in the movement of the paddle, a counterbalance force is not applied thereto. However, once the weight of paddle 26, which may be 16 to 32 ounces (for an illustrative embodiment) starts to become a factor in the dropping of the paddle, the counterbalance force of spring 46 is engaged to counterbalance this force and permit the paddle to ease into its feed position with little effort being required on the part of the operator to control the paddle. This prevents the paddle from banging into belt 22 or the bed of machine 12, thus protecting both the paddle and the belt/bed, thereby enhancing the durability of these parts and reducing potential maintenance problems. The tension of spring 46 is selected so that it exerts a force which is slightly less than the weight of the paddle, permitting the paddle to easily reach its feed position and remain in this position against the counterbalance force of spring 46; however, the tension of the spring carries most of the weight of the paddle when the paddle is being lifted, permitting the operator to lift the paddle to its inactive position without exerting substantial force. A support 53 limits movement of and supports the paddle assembly in the inactive position. The fact that counterbalance spring 46 exerts the greatest force on the paddle when the paddle is in the feed position further facilitates ease of operation for the operator in moving the paddle between its two positions. Cut outs 54 in the paddle also make it easier for the operator to hold onto and move the paddle.

Mount 40 is connected to bearings 56 which ride in a guide channel 58. For preferred embodiment, the bearings are heavy duty roller bearings capable of providing extended use with minimal maintenance. As will be discussed later, when paddle 26 is in its inactive position as shown in FIGS. 2A, 2B, mount 40 and paddle 26 connected thereto may be freely moved in either direction along guide channel 58 to facilitate easy repositioning of the paddle without operator strain.

Finally, a drive chain 60 is provided, only a small portion of which is shown in the Figures, which is selectively moved, normally forward, but under selected circumstances slightly backward, by a drive servo motor or other suitable drive component under control of processor 18. When paddle 26 is in its inoperative position as shown in FIGS. 2A, 2B, there is no engagement between the paddle and drive chain 60, so the chain has no effect on the paddle. However, when paddle 26 is in its feed position shown in FIG. 3, a pawl 62 mounted at the end of slide member 44 engages a link in chain 60. Pawl 62 is pivotably mounted to slide member 44 by a shaft 64 and is biased by a coil spring 65 on shaft 64 or other suitable means to the position shown in the figures. Pawl 62 has a triangular tip 66 which engages chain 60. This results in the chain being able to drive the pawl, and paddle 26 connected thereto, in forward direction 24 when the chain is moving in this direction, and in the operator being able to move the paddle in forward direction 24 when the chain is not moving; however, the chain cannot drive the paddle in the backward direction, nor can the operator move the paddle in that direction when chain 60 is not moving. The paddle also cannot normally be moved backwards by the pressure of the mail stack, the vertical rear surface of the pawl preventing any disengagement of the pawl from the chain as a result of such stack pressure. The only way that paddle 26 can be moved backward when pawl 62 is engaged in chain 60 is where processor 18 determines that there is excess pressure being applied by the stack to singulation head 14 and backs chain 60 off slightly to relieve this pressure. Under these circumstances, the mail stack will exert a force on paddle 26 to move the paddle back slightly, thereby relieving the pressure. In this limited case, the movement of the paddle as a result of stack pressure should substantially correspond to the backward movement of chain 60. A standard motor overload protection mechanism may be provided for the drive mechanism of chain 60 in some applications.

The embodiment of FIG. 2B differs from that of FIG. 2A only in that buttons 50 and 52 have been replaced by dowel pin 70 and hook 72 respectively, and in that a chain hold-down 74 attached to mount 40 behind slide 44 has been added. These changes have been made to provide a positive disengagement for pawl 62 from chain 60. While the force of counterbalance spring 46 is normally sufficient to disengage pawl 62 from chain 60 when the paddle assembly is being raised from its feed to its inactive position, it is possible, particularly when significant back pressure is being applied by the mail stack to paddle 26, for the pawl to become jammed in the chain so that merely raising the paddle is not sufficient to provide disengagement. Since, as will be discussed shortly, the operator may be using one hand to hold a stack of mail while lifting the paddle with the other hand, it may be difficult for the operator to free the pawl, and attempts to do so may result in injury to the operator's fingers.

The arrangement of FIG. 2B is therefore considered preferable in that it provides positive disengagement of the pawl from the chain as the paddle is lifted. This is accomplished by pin 70 entering hook 72 when the paddle is for example at approximately a 45° angle and pushing down on slide 44 against the action of counterbalance spring 46 during the remaining downward movement of the paddle, this functioning to control the downward movement of the paddle in the same manner as for the embodiment of FIG. 2A. However, for this embodiment of the invention, when the paddle is lifted, dowel pin 70 engages the top of hook 72 to lift the hook, and thus slide 44 and pawl 62 attached thereto, as the paddle is lifted. The lifting of the paddle thus positively disengages pawl 72 from chain 60, assuring disengagement, even when the pawl has become slightly jammed in the chain. When the paddle reaches an angle of approximately 45° in its upward movement, the direction of pin movement is toward the open side of the hook, permitting pin 72 to disengage from the hook and return to the position shown in FIG. 2B. Hold-down 74 is provided because, if the pawl is jammed in chain, the chain may lift with the pawl preventing clean disengagement. Hold-down 74 prevents lifting of the chain behind the pawl to assure positive disengagement.

One feature of the invention which further facilitates both good engagement of pawl 62 with chain 60 and clean disengagement of the pawl and chain is that, rather than pawl 62 entering the chain with the pawl moving at an angle to the chain, for example being rotated into the chain, as is the case in some prior art devices, slide 44 and pawl 62 attached thereto move substantially vertically in a direction substantially perpendicular to the chain. This feature provides cleaner engagement and disengagement and thus more reliable operation.

In operation, paddle 26 is initially lifted to the position shown in FIGS. 2A, 2B and slid rearward along channel 58 to a desired rear position. The paddle is then lowered in the manner previously described to serve as a support for mail being stacked, permitting the operator to then grab mail with one hand or both and form a mail stack ahead of the follower until the stack comes close to singulation head 14. The operator may then place his/her left hand behind paddle 16 and move the paddle assembly forward, pawl 62 ratcheting over chain 60 to facilitate its movement. Once the stack is positioned, the motor driving chain 60 may be turned on to bring the stack against singulation head 14 with the appropriate pressure. The chain may then move paddle 26 in a manner indicated in the before mentioned Ser. No. 09/499,184 co-pending application to maintain the desired stack pressure and orientation with respect to singulation head 14.

Sometimes the operator may want to add mail to the stack before the existing stack is exhausted. To do this, the operator would lift the paddle 26 and move it back as previously described, but would have to hold the existing stack in place with the right hand. Once paddle 26 has been repositioned, additional mail can be stacked behind the existing stack using one or both hands until the space between the stack and the paddle had been filled. Once this space is filled, the operation would proceed as previously indicated.

While the invention has been described above with reference to preferred embodiments, and some variations have been discussed, it is apparent that these embodiments are for purposes of illustration only, and that many variations on these embodiments are possible. Thus, for example, while the particular bearing mechanism and the particular ratchet drive shown in the figures is currently preferred, other bearing mechanisms and other drives, preferably ratchet drives, might be used in suitable applications. Similarly, while the spring mechanism shown is a currently preferred implementation for the counterbalancing operation, other counterbalancing mechanisms might also be employed. The paddle assembly may for some embodiments include only a paddle or may include components in addition to or instead of those shown. Other positive disengagement mechanisms and other chain hold-down mechanisms might also be employed. Further, while the invention as being described above primarily with respect with a mixed mail application, the invention could also find use in other applications where flat articles need to be stacked for future processing. Thus, while the invention is being particularly shown and described above with reference to preferred embodiments, the foregoing and other changes, in form and detail may be made therein by one skilled in the art while still remaining within the spirit and scope of the invention, which is to be defined only by the appended claims.

What is claimed is:

1. In a system for feeding flat articles in a selected direction, a follower mechanism including:

a paddle assembly;

a mount to which said paddle assembly is pivotably connected, said paddle assembly being pivotable on the mount between a feed position and an inactive position;

a guide connected to said mount, said guide facilitating movement of said mount only forward and backward in said selected direction;

a drive providing controlled movement in said selected direction; and a mechanism connecting said mount to be driven forward in said selection direction by said drive, while inhibiting backward movement of said mount, when the paddle assembly is in its feed position, said mechanism permitting said mount to be freely moved forward and backward when said paddle assembly is in its inactive position.

2. A follower mechanism as claimed in claim 1 including a counterbalance mechanism which controls pivoted movement of said paddle assembly between its two positions.

3. A follower mechanism as claimed in claim 2 wherein said counterbalance mechanism applies a force to said paddle assembly which assists in raising said paddle assembly from its feed to its inactive positions and which partially supports the weight of the paddle assembly when the paddle assembly is lowered from its inactive to its feed position.

4. A follower mechanism as claimed in claim 3 wherein said counterbalance mechanism includes a compression spring mechanism positioned in said mount.

5. A follower mechanism as claimed in claim 3 wherein said counterbalance mechanism experts greatest force on said paddle assembly when said paddle assembly is in said feed position.

6. A follower mechanism as claimed in claim 2 wherein said mechanism connecting said mount to be driven includes a slide member normally biased to a raised position, said slide member interacting with said paddle assembly, starting at a point in the movement of the paddle assembly between its inactive and feed positions, to move said slide member downward toward said drive, said slide member including a component at the bottom thereof which engages said drive when said paddle assembly has reached its feed position.

7. A follower mechanism as claimed in claim 6 wherein said drive is a chain driven and said component at the bottom of the slide member is a pawl.

8. A follower mechanism as claimed in claim 6 wherein said slide is biased to its raised position at least in part by said counterbalance mechanism.

9. A follower mechanism as claimed in claim 1 wherein said mechanism connecting said mount to be driven includes a slide member normally biased to a raised position, said slide member interacting with said paddle assembly starting at a point in the movement of the paddle assembly between its inactive and feed positions to move said slide downward toward said drive, said slide member including a component at the bottom thereof which engages said drive when said paddle assembly has reached its feed position.

10. A follower mechanism as claimed in claim 9 wherein said drive is a chain drive and said component at the bottom of the slide member is a pawl.

11. A follower mechanism as claimed in claim 10 wherein said pawl is shaped to prevent disengagement of said pawl from said chain as a result of back pressure applied to said paddle assembly.

12. A follower mechanism as claimed in claim 10 including a mechanism operative in response to said paddle assembly being moved from its feed to its inactive position for positively disengaging said pawl from said chain.

13. A follower mechanism as claimed in claim 12 wherein said mechanism for positively disengaging includes a hook on said slide and a pin on said paddle assembly, said pin being engaged by said hook during portions of pivot movement of said paddle assembly which are in a direction substantially perpendicular to said chain.

14. A follower mechanism as claimed in claim 12 including a hold-down member for said chain, said hold-down member facilitating disengagement of said pawl from said chain.

15. A follower mechanism as claimed in claim 12 wherein said hold-down member is attached to said mount.

16. A follower mechanism as claimed in claim 10 wherein said mechanism connecting the mount causes said pawl to be moving substantially perpendicular to said chain when the pawl engages the chain and when the pawl disengages from the chain.

17. A follower mechanism as claimed in claim 1 wherein said guide is a bearing.

18. In a system for feeding flat articles in a selected direction, a follower mechanism including:

a paddle assembly;

a mount to which said paddle assembly is pivotably connected, said paddle assembly being pivotable on the mount between a feed position and an inactive position;

a guide connected to said mount, said guide facilitating movement of said mount only forward and backward in said selected direction;

a counterbalance mechanism which controls pivoted movement of said paddle assembly between its two positions; and a drive mechanism controllably moving said mount in said selected direction when said paddle assembly is in its feed position.

19. A follower mechanism as claimed in claim 18 wherein said counterbalance mechanism applies a force to said paddle assembly which assists in raising said paddle assembly from its feed to its inactive positions and which partially supports the weight of the paddle assembly when the paddle assembly is lowered from its inactive to its feed position.

20. A follower mechanism as claimed in claim 19 wherein said counterbalance mechanism includes a compression spring mechanism positioned in said mount.

21. A follower mechanism as claimed in claim 19 wherein said counterbalance mechanism experts greatest force on said paddle assembly when said paddle assembly is in said feed position.

* * * * *

UNITED STATES PATENT AND TRADEMARK OFFICE

CERTIFICATE OF CORRECTION

PATENT NO. : 6,354,587 B1
DATED : March 12, 2002
INVENTOR(S) : Edward S. Engarto It is certified that error appears in the above-identified patent and that said Letters Patent is hereby corrected as shown below:

Title page,
Item [73], should read as follows:

-- [73] Assignee: Lockheed Martin Corporation, Bethesda, Maryland --.

Signed and Sealed this

Eighteenth Day of February, 2003

JAMES E. ROGAN
*Director of the United States Patent and Trademark Office*